US008059042B2

(12) United States Patent
Su et al.

(10) Patent No.: US 8,059,042 B2
(45) **Date of Patent: *Nov. 15, 2011**

(54) SHORTED MONOPOLE ANTENNA

(75) Inventors: Saou-Wen Su, Taipei (TW); Jui-Hung Chou, Taichung (TW)

(73) Assignees: Silitek Electronic (Guangzhou) Co., Ltd., Guangzhou (CN); Lite-On Technology Corporation, Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 12/956,353

(22) Filed: Nov. 30, 2010

(65) Prior Publication Data

US 2011/0074654 A1 Mar. 31, 2011

Related U.S. Application Data

(63) Continuation of application No. 12/230,302, filed on Aug. 27, 2008, now abandoned.

(30) Foreign Application Priority Data

Jul. 11, 2008 (CN) ..... 2008 1 0133548

(51) Int. Cl.
*H01Q 1/24* (2006.01)

(52) U.S. Cl. ..... 343/702; 343/700 MS

(58) Field of Classification Search ..... 343/700 MS, 343/702

See application file for complete search history.

(56) References Cited

U.S. PATENT DOCUMENTS

2009/0073046 A1* 3/2009 Chang et al. ..... 343/700 MS
2009/0115664 A1* 5/2009 Chung et al. ..... 343/700 MS

* cited by examiner

*Primary Examiner* — Jacob Y Choi
*Assistant Examiner* — Kyana R McCain
(74) *Attorney, Agent, or Firm* — Li&Cai Intellectual Property (USA) Office

(57) ABSTRACT

The present invention is related to a shorted monopole antenna. The antenna includes a ground portion, a radiating portion, a shorting portion, an assembling portion, and a coaxial cable. The ground portion includes a signal grounding point. The radiating portion is located above the ground portion and bent at least once, and includes a signal feeding point. One end of the shorting portion is connected to one of the short edges of the ground portion, and the other end is connected to one edge portion of the radiating portion. The assembling portion is connected to the long edge of the ground portion. The coaxial cable includes an inner conductor and an outer conductor, which are connected to the signal feeding point and the signal grounding point respectively. The antenna invented has good impedance bandwidth and radiation characteristics, can easily be installed inside the housing of an electronic device, and is well suitable for applications in wireless communications devices.

9 Claims, 5 Drawing Sheets

SHORTED MONOPOLE ANTENNA

REFERENCE TO RELATED APPLICATION

This patent application is a Continuation of patent application Ser. No. 12/230,302, filed 27 Aug. 2008, abandoned.

BACKGROUND OF THE INVENTION

1. Field of the Invention

The present invention relates to a built-in antenna. The present invention in particular relates to a low profile shorted monopole antenna formed by a single metal sheet and capable of operating in the 2.4 GHz band.

2. Description of Related Art

With the development of wireless communication technology, various wireless products are widely marketed every year. Consequently related electronic circuit system and product design are focused for study and research. The mobile-unit antenna currently applied in WLAN system is a metal-plate structure or a PCB structure. The metal-plate antenna feeds RF signal by a mini-coaxial cable. On the other hand, the antenna of PCB type is almost a planar inverted-F antenna (PIFA), which is a planar antenna of inverted-F shape, and it is manufactured as a monopole antenna. The monopole antenna is constructed by a radiating unit and a grounding unit, which are separated units and do not connect with each other. An additional dielectric substrate is used for structure support for the radiating and grounding unit, and therefore the radiating rand grounding unit are printed on the dielectric substrate.

Generally speaking, the cost for manufacturing antenna of PCB type is higher than that for manufacturing the metal-plate antenna. A traditional planner monopole antenna is disclosed in Taiwan patent N.O. 00573382. The radiating unit and the grounding unit are respectively printed on two sides of a single dielectric substrate and the signals are fed in by a micro strip and a coaxial cable. According to other related patents, such as U.S. Pat. No. 6,600,448 and US 2007/0296636, the metal-plate antenna is made by molding and pressing the metal material. The two patents disclose a planar inverted-F antenna and the radiating unit and the grounding unit are formed on the same surface. Therefore, the necessary size of the antenna negatively affects the required space for the antenna, which is undesirable in this age of miniaturization.

SUMMARY OF THE INVENTION

The primary object of the present invention is to provide a shorted monopole antenna, and in particular an antenna with a low profile. The shorted monopole antenna is formed from a single metal sheet and it is applied to wireless band of 2.4 GHz. The antenna is suitable for being assembled inside a laptop computer, a wireless printer, and other wireless products that require or desire reduction in product size.

A single metal sheet is used for forming the antenna with a ground portion and a radiating portion by bending the metal piece according to the present invention. The radiating portion has at least one bent section so as to reduce the height of the antenna and is disposed above the ground portion. Furthermore, a shorting portion is used for connecting the radiating portion with the ground portion so that the radiating portion, the ground portion, and the shorting portion can be manufactured integrally in one piece. In another embodiment, an assembling portion connects to a long edge of the ground portion and performs as a grounding unit; therefore the antenna can be assembled flexibly. The shorted monopole antenna of the present invention can be applied to wireless band of 2.4 GHz (2400 to 2484 MHz) or for a band of 802.11b/g/n, and the antenna can be built in the wireless devices.

In order to achieve the above object, the present invention provides a shorted monopole antenna. The shorted monopole antenna made from a single metal sheet comprises a ground portion having a short edge and a long edge having a signal grounding point, a shorting portion folded and extended upwardly from the short edge of the ground portion near the signal grounding point, a radiating portion having a first radiating section and a second radiating section, the first radiating section and the second radiating section defining a single path of resonance at a single frequency band, wherein the first radiating section is folded from the shorting portion and configured substantially parallel to the ground portion, the second radiating section is folded from the first radiating section at a specific angle and has a signal feeding point corresponding to the signal grounding point, the first radiating section and the second radiating section are joined by a bent section, and a coaxial cable having an inner conductor and an outer conductor, the inner and the outer conductors being connected electrically to the signal feeding point and the signal grounding point respectively. Thereby the antenna performs with good impedance bandwidth and radiation characteristics, and it is suitable for assembling inside the housing of the wireless units. It's proved that the antenna can operate in the frequency of wireless network of 2.4 GHz.

The present invention provides a shorted monopole antenna which is formed by bending a single metal sheet. The formed antenna system has a radiating portion and a ground portion that performs with good impedance bandwidth and radiation characteristics. Furthermore, the formed antenna system has an assembling portion which is used for assembling with a predetermined unit and the assembling portion will not affect the influence regarding the performance of the antenna system in the frequency band of 2.4 GHz. Therefore, the antenna of the present invention is flexibly assembled inside the wireless products and the assembling portion can be designed to have mechanisms to enable assembling or attachment on to the desired electrical devices or wireless products.

In order to better understand the characteristics and technical contents of the present invention, a detailed description thereof will be made with reference to accompanying drawings. However, it should be understood that the drawings and the description are illustrative only and are not used to limit the scope of the present invention.

DETAILED DESCRIPTION OF PREFERRED EMBODIMENTS

Figure 1:
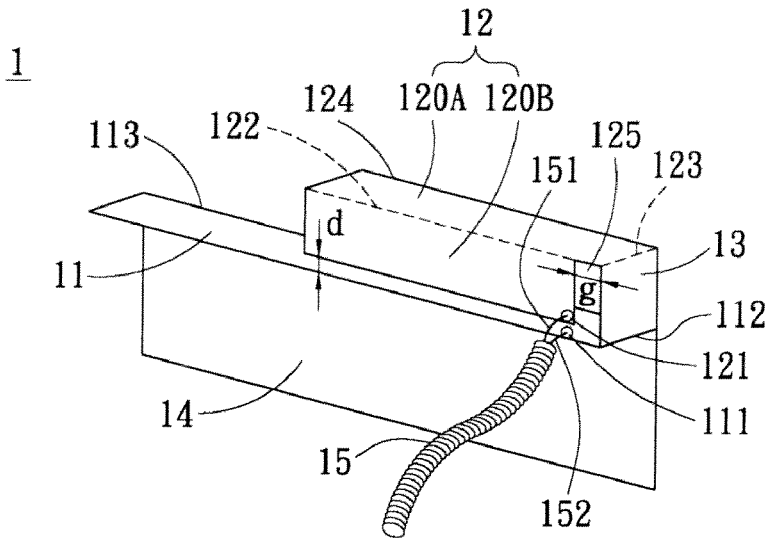
FIG. 1 shows the first embodiment of the shorted monopole antenna according to the present invention.
Figure 1A:
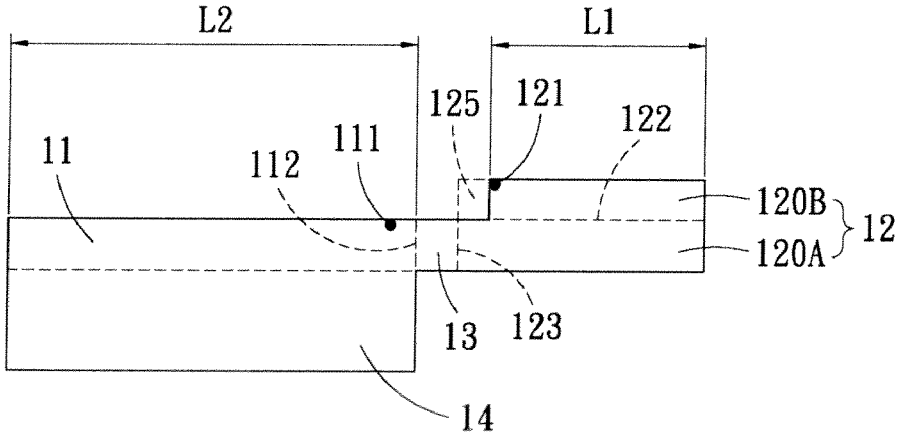
FIG. 1A shows the first embodiment of the shorted monopole antenna, before being formed, as a single metal sheet according to the present invention.

Please refer to FIGS. 1 and 1A, the present invention discloses a shorted monopole antenna 1. The first embodiment of the formed shorted monopole antenna 1 is shown in FIG. 1, and FIG. 1A shows the shorted monopole antenna 1 before being formed, as a single metal sheet. The shorted monopole antenna 1 includes a ground portion 11, a radiating portion 12, a shorting portion 13, a assembling portion 14, and a coaxial cable 15, and the above-mentioned elements (except the coaxial cable 15) are formed by bending a signal metal sheet. The ground portion 11 defines a short edge 112, a long edge 113, and has a signal grounding point 111.

The shorting portion 13 is folded and extended upwardly from the short edge 112 of the ground portion 11 near the signal grounding point 111. The radiating portion 12 is located above the ground portion 11 and it is bent by a bent section 122. In other words, the radiating portion 12 has a first radiating section 120A and a second radiating section 120B, and the bent section 122 is formed between the first radiating section 120A and the second radiating section 120B. In physic structure, the first radiating section 120A is folded and extended horizontally from the shorting portion 13, and the second radiating section 120B is folded relative to the first radiating section 120A and towards the ground portion 11. In other words, the first radiating section 120A is configured substantially parallel to the ground portion 11. Furthermore, the radiating portion 12 has a signal feeding point 121 on the second radiating section 120B, and the signal feeding point 121 is corresponding to the signal grounding point 111. Furthermore, the signal feeding point 121 and the signal grounding point 111 are approximate the shorting portion 13. The radiating portion 12 defines a side 124 and an edge portion 123. One side of the shorting portion 13 connects to the short edge 112 of the ground portion 11 and another side of the shorting portion 13 connects to the edge portion 123 of the first radiating section 120A of the radiating portion 12. Regarding with the electron/signal current, the first radiating section 120A and the second radiating section 120B define a single path of resonance at a single frequency band, i.e., the shorted monopole antenna 1 is an antenna working at one single frequency band.

The assembling portion 14 connects to the long edge 113 of the ground portion 11. The coaxial cable 15 has an inner conductor 151 and an outer conductor 152, wherein the inner and the outer conductors 151, 152 connects electrically to the signal feeding point 121 and the signal grounding point 111 respectively.

The shorted monopole antenna 1 is formed by folding a single metal sheet, and the single metal sheet has an elongated portion and a protruding portion extending partially from the elongated portion. The elongated portion is defined as the ground portion 11, the shorting portion 13 and the first radiating section 120A of the radiating portion 12. Furthermore, the protruding portion of the single metal sheet performs as the second radiating section 120B of the radiating portion 12.

Moreover, the second radiating section 120B has an exposed structure 125 so that the second radiating section 120B is physically isolated from the shorting portion 13 by a separating gap "g", e.g., the second radiating section 120B is not directly contacting the shorting portion 13.

Alternatively, the ground portion 11, the radiating portion 12, the shorting portion 13, and the assembling portion 14 are made of conducting material. The metal sheet shown in FIG. 1A is used for forming the shorted monopole antenna 1 by bending methods such as a punching method. After forming process, a specific feeding gap d is selected between the second radiating section 120B and the ground portion 11 is adjusted for balancing the inductive reactance and the capacitive reactance so that the well-defined VSWR (Voltage Standing Wave Ratio) of 1.5:1 is achieved.

Figure 2:
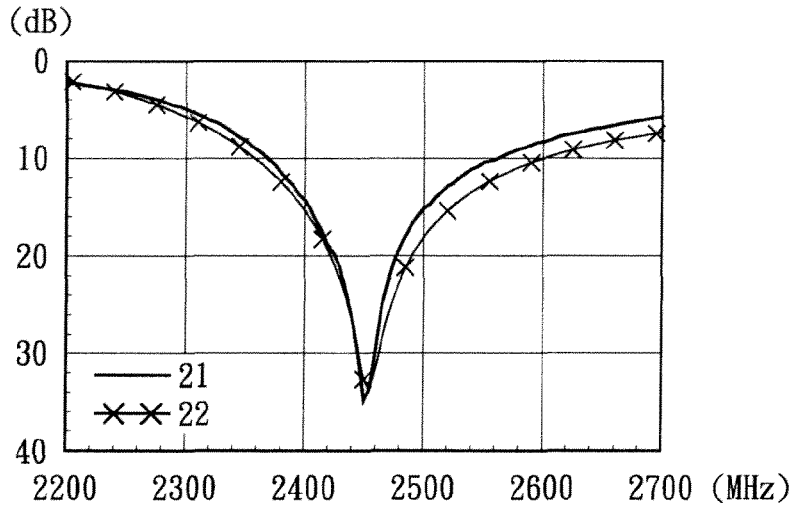
FIG. 2 shows the measured and simulated return loss of the first embodiment of the shorted monopole antenna according to the present invention.

FIG. 2 shows the measured and simulated return loss of the shorted monopole antenna 1. The X-axis and the Y-axis represents the operating frequency (MHz) and the return loss (dB) respectively. In the first embodiment, the length and the width of the ground portion 11 are 40 mm and 5 mm respectively. The length of the radiating portion 12 is 23 mm, and the width and the height of the radiating portion 12 are both 5 mm (i.e. the length of the radiating portion 12, e.g., L1 is shorter than that of the ground portion 11, e.g., L2, and the width of the radiating portion 12 is not longer than that of the ground portion 11 as shown in FIG. 1A). The feeding gap d between the radiating portion 12 and the ground portion 11 is 1 mm (note that the feeding gap d can be a value smaller than 1.5 mm). The width and the length of the shorting portion are both 5 mm and the separating gap g between the second radiating section 120B of the radiating portion 12 and the shorting portion 13 is equal to 2 mm. Moreover, the length and the width of the assembling portion 14 are 40 mm and 10 mm respectively. According to FIG. 2, in the definition of VSWR of 1.5:1 or return loss of 14 dB, the antenna 1 has good impedance matching in wireless frequency band of 2.4 GHz. In addition, the measured return-loss line 21 well matches with the simulated return-loss line 22.

Figure 3:
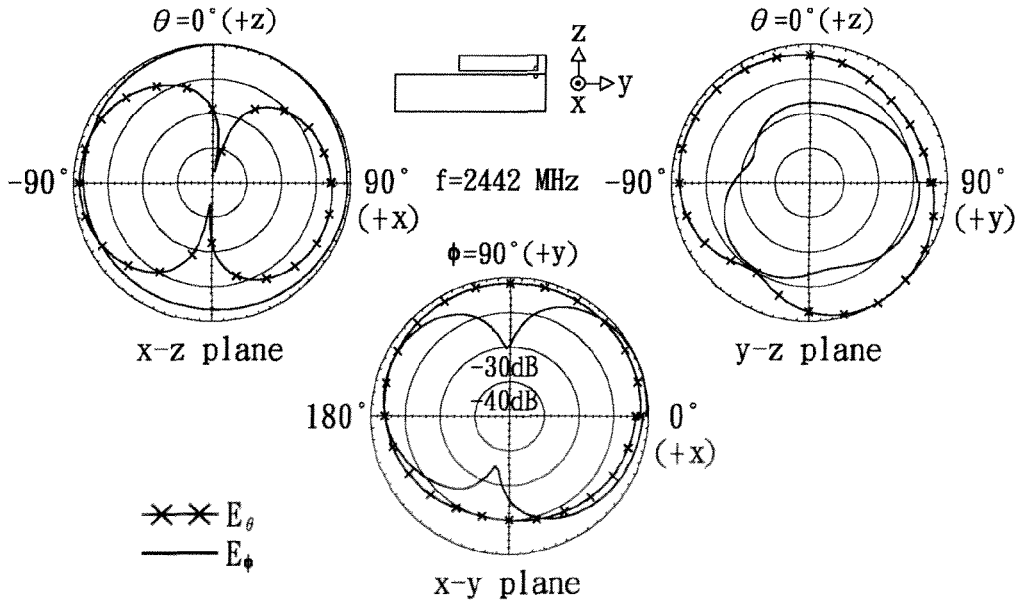
FIG. 3 shows the measured radiation pattern of the first embodiment of the shorted monopole antenna operating at 2442 MHz according to the present invention.

The radiation pattern of the shorted monopole antenna 1 operating at 2442 MHz is shown in FIG. 3. According to the measured results, the radiation pattern on the X-Y plane is omni-directional.

Figure 4:
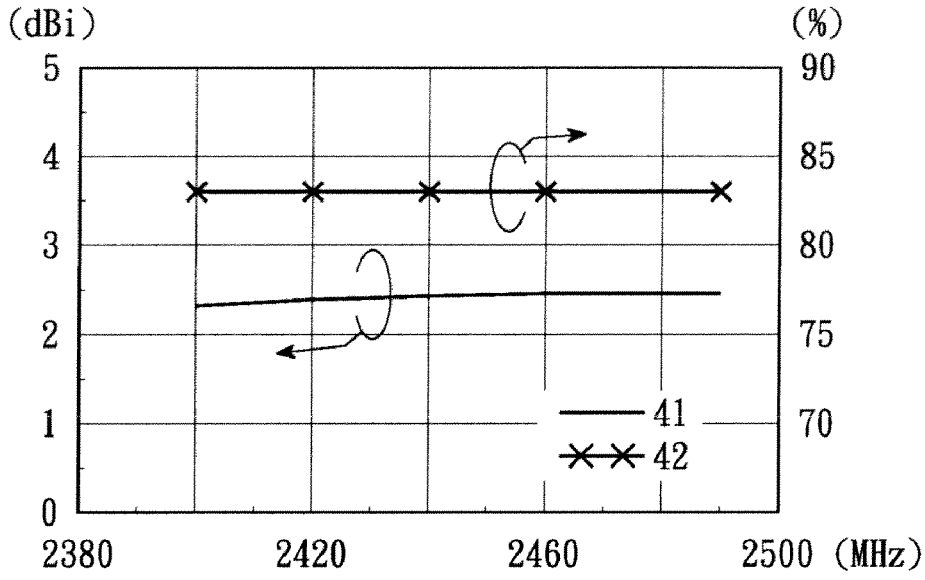
FIG. 4 shows the gain and radiation efficiency of the first embodiment of the shorted monopole antenna according to the present invention.

The measured antenna gain and radiation efficiency of the shorted monopole antenna 1 are shown in FIG. 4. The left-hand Y axis and the right-hand Y axis respectively represent the gain of antenna (dBi) and the radiation efficiency of antenna (%). Similar to FIG. 2. X axis represents the operating frequency (MHz). According to FIG. 4, the measured gain 41 shows that the value of the gain of antenna is 2.4 dBi and the measured data of efficiency 42 shows that the value of the radiation efficiency of antenna is 83%. Basically, the values of the operating data of the antenna in wireless frequency band of 2.4 GHz are qualified for wireless applications.

Figure 5:
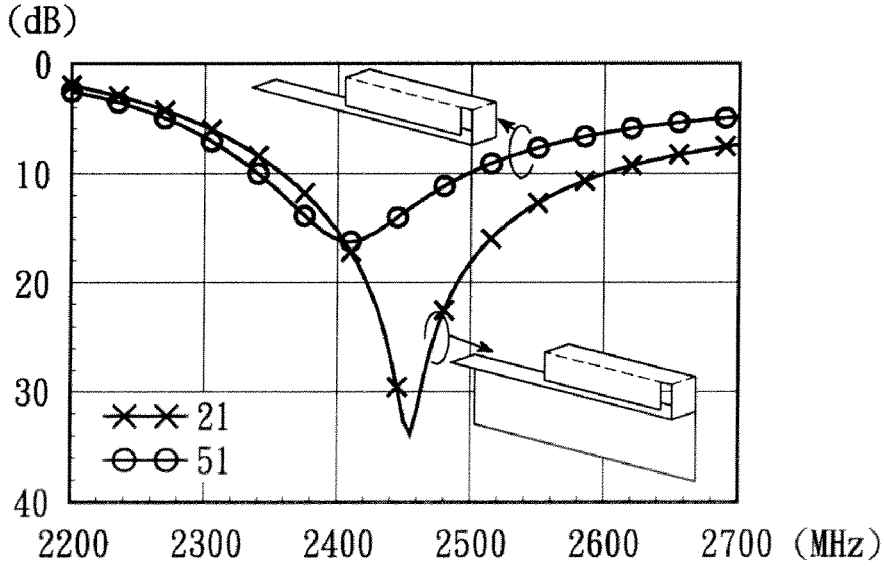
FIG. 5 shows the simulated return loss of the first embodiment of the shorted monopole antenna with/without the assembling portion according to the present invention.

FIG. 5 shows the simulated return loss of the first embodiment with and without the assembling portion 14. According to simulated line 51 of return loss; the impedance bandwidth of the shorted monopole antenna 1 without assembling portion 14 is qualified for 2.4 GHz wireless applications.

Figure 6:
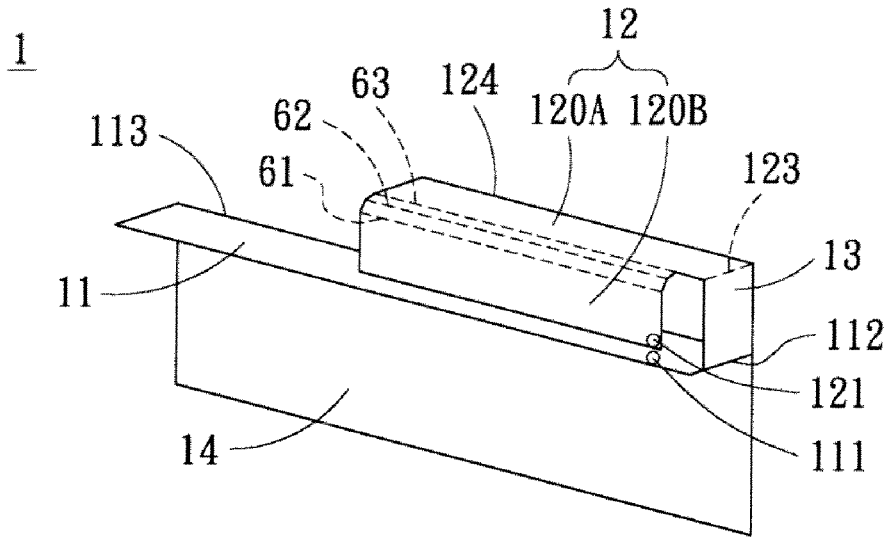
FIG. 6 shows the second embodiment of the shorted monopole antenna according to the present invention.

FIG. 6 shows the second embodiment of the present invention. The difference between the first and the second embodiments is that the radiating portion 12 has three bent lines, i.e. the first bent line 61, the second bent line 62, and the third bent line 63 and these bent lines are parallel to each other. By the above-described structure, the height of the shorted monopole antenna 1 can be reduced so that it can be easily assembled within a smaller space required.

Figure 7:
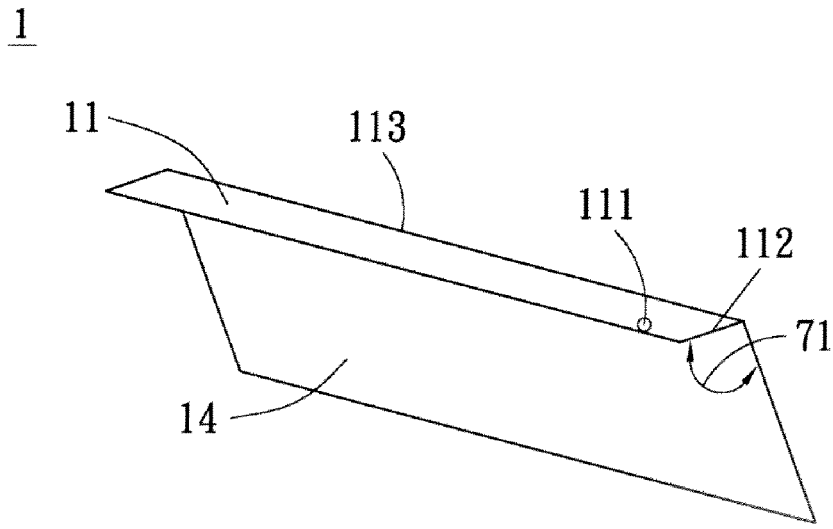
FIG. 7 shows the angle between the assembling portion and the ground portion of the third embodiment according to the present invention.

FIG. 7 shows the third embodiment of the present invention. The difference between the third and another embodiment is that the angle 71 between the assembling portion 14 and the ground portion 11 is not exactly 90 degrees. In this embodiment, the assembling portion 14 "swings" away from the ground portion 11, wherein the angle 71 between the assembling portion 14 and the ground portion 11 is larger than 90 degrees. Note that other elements such as radiating portion 12 of the antenna are not illustrated in FIG. 7, and the undrawn elements are similar to those of the first and second embodiments. Thus, the assembling portion 14 is used for being assembled within a housing of a wireless product, and the ground portion 11, the radiating portion 12, and the shorting portion 13 can rotate to a specific angle in order to be applied to and fit in the space of the housing.

Figure 8:
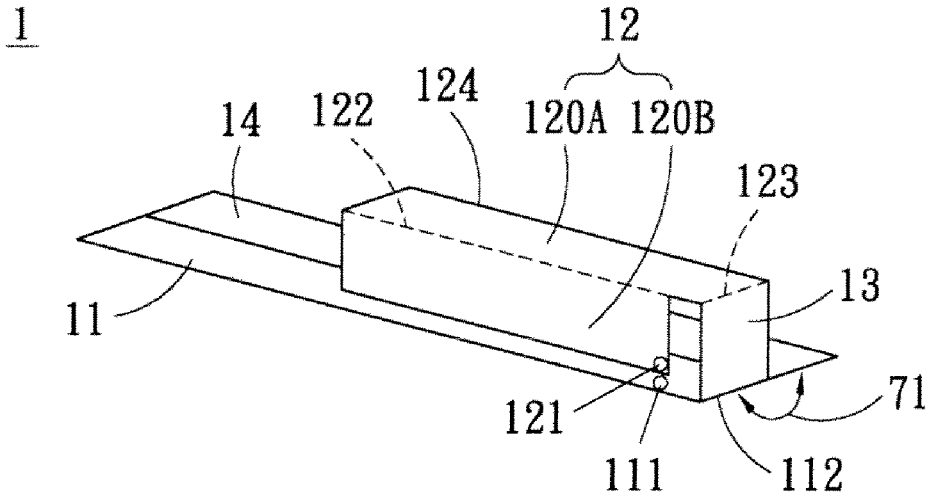
FIG. 8 shows the fourth embodiment of the shorted monopole antenna according to the present invention.

FIG. 8 shows the fourth embodiment of the shorted monopole antenna 1. The width of the assembling portion 14 is equal to that of the ground portion 11. Moreover, the angle 71 between the assembling portion 14 and the ground portion 11 approximates 180 degrees. Note that other elements such as radiating portion 12 of the antenna are the same as those of the first embodiment. Thus, the size of the shorted monopole antenna 1 can be further reduced because of the smaller assembling portion 14 and the smaller ground portion 11. Similarly, the angle 71 can be adjusted for assembling the shorted monopole antenna 1 on a wireless device. In the fourth embodiment, the angle 71 is preferably between 45 to 180 degrees.

Figure 9:
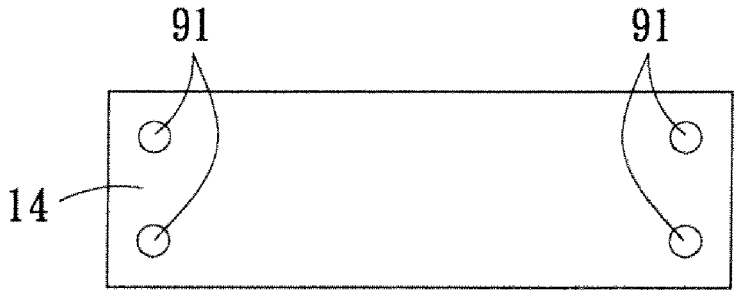
FIG. 9 shows the assembling portion of the shorted monopole antenna according to the present invention.

FIG. 9 shows the assembling portion 14 of the shorted monopole antenna 1. The assembling portion 14 has a plurality of holes 91 thereon for assembling the antenna on the base (i.e. one of the possible mechanism to enable assembling or attachment). For example, welding posts are assembled with the holes 91 to fix the antenna on a predetermined position.

The antenna of the present invention has a simplified structure and is easily to manufacture. Furthermore, the shorted monopole antenna 1 can be easily integratedly with wireless products.

Although the present invention has been described with reference to the foregoing preferred embodiment, it shall be understood that the present invention is not limited to the details thereof. Various equivalent variations and modifications may occur to those skilled in this art in view of the teachings of the present invention. Thus, all such variations and equivalent modifications are also embraced within the scope of the present invention as defined in the appended claims.

What is claimed is:

1. A shorted monopole antenna made from a single metal sheet, comprising:

a ground portion having a short edge and a long edge having a signal grounding point;

a shorting portion folded and extended upwardly from the short edge of the ground portion near the signal grounding point;

a radiating portion having a first radiating section and a second radiating section, the first radiating section and the second radiating section defining a single path of resonance at a single frequency band, wherein the first radiating section is folded from the shorting portion and configured substantially parallel to the ground portion, the second radiating section is folded from the first radiating section at a specific angle and has a signal feeding point corresponding to the signal grounding point, the first radiating section and the second radiating section are joined by a bent section; and a coaxial cable having an inner conductor and an outer conductor, the inner and the outer conductors being connected electrically to the signal feeding point and the signal grounding point respectively;

wherein the shorted monopole antenna is formed by folding the single metal sheet, the single metal sheet has an elongated portion and a protruding portion extending partially from the elongated portion, the elongated portion is defined as the ground portion, the shorting portion and the first radiating section of the radiating portion, and the protruding portion performs as the second radiating section of the radiating portion.

2. The shorted monopole antenna according to claim 1, further comprising a assembling portion folded and extended from the long edge of the ground portion.

3. The shorted monopole antenna according to claim 2, wherein a feeding gap width between the second radiating section and the ground portion is less than 1.5 mm.

4. The shorted monopole antenna according to claim 2, wherein the shorting portion is located between the first radiating section of the radiating portion and the ground portion.

5. The shorted monopole antenna according to claim 2, wherein the bent section includes a plurality of parallel bending lines.

6. The shorted monopole antenna according to claim 2, wherein the angle between the assembling portion and the ground portion is ranged from 45 to 180 degrees.

7. The shorted monopole antenna according to claim 2, wherein the assembling portion further comprises a plurality of holes thereon.

8. The shorted monopole antenna according to claim 1, wherein the length of the radiating portion is shorter than the length of the ground portion, and the width of the radiating portion is shorter than or equal to the width of the ground portion.

9. The shorted monopole antenna according to claim 1, wherein the second radiating section has an exposed structure so that the second radiating section is physically isolated from the shorting portion by a separating gap.

* * * * *